United States Patent [19]

Kuroda et al.

[11] 4,084,114

[45] Apr. 11, 1978

[54] SUBSTRATE ASSEMBLY FOR A LUMINESCENT DISPLAY PANEL WHEREIN GRAPHITE POWDER IS BOUND INTO SEGMENTED ELECTRODES BY GLASS CONTAINING ZINC OXIDE

[75] Inventors: Toshiro Kuroda; Susumu Kakami, both of Nagoya, Japan

[73] Assignees: Narumi China Corporation; Nippon Electric Kagoshima, Limited, both of Japan

[21] Appl. No.: 701,996

[22] Filed: Jul. 1, 1976

[30] Foreign Application Priority Data

Jul. 11, 1975 Japan ..... 50-85667

[51] Int. Cl.[2] ..... H01J 29/08; H01J 29/30; H01B 1/06

[52] U.S. Cl. ..... 313/496; 252/506; 313/218; 313/517

[58] Field of Search ..... 313/496, 497, 495, 218, 313/517, 519; 252/506

[56] References Cited

U.S. PATENT DOCUMENTS

| | | | |
|---|---|---|---|
| 3,532,640 | 10/1970 | Scharrer et al. | 252/506 |
| 3,906,269 | 9/1975 | Tanji | 313/496 |

*Primary Examiner*—Palmer C. Demeo

*Attorney, Agent, or Firm*—Hopgood, Calimafde, Kalil, Blaustein and Lieberman

[57] ABSTRACT

A substrate assembly for a fluorescent or phosphorescent display panel comprises segmented electrodes, for deposition thereon of masses of a fluorescent or phosphorescent material, respectively, on electroconductive leads disposed on a substrate of an electrically insulating material, such as glass or ceramics. Each segmented electrode comprises graphite powder bound into a mass by a zinc oxide containing vitreous material that does not substantially include lead. The segmented electrode may consist of an intermediate layer placed on each electroconductive lead and a segmented layer disposed on the intermediate layer.

3 Claims, 2 Drawing Figures

SUBSTRATE ASSEMBLY FOR A LUMINESCENT DISPLAY PANEL WHEREIN GRAPHITE POWDER IS BOUND INTO SEGMENTED ELECTRODES BY GLASS CONTAINING ZINC OXIDE

BACKGROUND OF THE INVENTION

This invention relates to a substrate assembly for a fluorescent or phosphorescent display panel.

A fluorescent or phosphorescent display panel, namely, a luminescent display panel as called in general herein, comprises a substrate assembly comprising, in turn, a substrate of an electrically insulating material, such as glass or ceramics, a plurality of electroconductive electrodes on the substrate, and segmented electrodes on the electroconductive electrodes, respectively. As will become clear later, each segmented electrode may consist of a graphite intermediate layer disposed on each electroconductive electrode and a segmented layer placed on the intermediate layer. A mass of a luminescent material is deposited on each segmented layer or electrode. Each segmented electrode is generally placed in an indent formed in the substrate in a corresponding geometrical configuration with the luminescent mass disposed also therein so as not to protrude outwardly of the general surface of the substrate. The expression "on the substrate" should therefore be understood to mean that the segmented electrodes and luminescent masses do not necessarily protrude from the general substrate surface. Each segmented electrode and the luminescent mass deposited thereon form a display electrode. The substrate may be a composite substrate having two or more substrate layers.

For a multi-digit luminescent display panel, such a substrate assembly is sealed in a vacuum envelope together with a grid for each digit and at least one hot cathode for a plurality of digits.

Alternatively, a cup-shaped cover glass sheet is hermetically sealed at its periphery to such a substrate assembly after the grids and cathode or cathodes are preliminarily attached to the latter. A substrate assembly therefore further comprises supports for the grids and cathode. A plurality of electroconductive leads are disposed on the substrate to provide electric connections to the electroconductive electrodes and the grid and cathode supports.

It has been the practice to manufacture the electroconductive electrodes and leads by firing prints formed, on a glass or a ceramic substrate, of silver or silver-palladium paste at about 600° C. Thereafter, a film of an electrically insulating vitreous material is put by screen printing on the substrate and the electroconductive electrodes and leads with openings provided through the print of film at positions where the segmented electrodes should subsequently be formed. The print of film is fired at about 600° C to provide an insulating film. The openings thereby become indents formed in a composite substrate. The graphite intermediate layers of the segmented electrodes are formed by disposing in the respective indents, by printing, masses of a paste-like composition consisting essentially of graphite powder and a low melting point vitreous material that includes lead oxide. The printed masses are fired at about 600° C. The segmented layers are made by similarly firing prints of the paste-like composition. Alternatively, the segmented layers may be made by firing prints of silver or other metal paste at about 600° C. The vitreous material includes lead oxide because this lowers the melting point and renders the composition suitable to printing.

The graphite intermediate layers increase the brightness of luminescence of the luminescent masses when used together with a very small amount of the vitreous material. They, however, do not tenaciously adhere to the underlying electroconductive electrodes and particularly to the insulating film and come off together with the luminescent masses when it is desired to remove those luminescent masses for reuse of the substrate assembly at least one of which is inadvertently wrongly deposited on the graphite layer. The adhesion is enhanced by increasing the content of the vitreous material in the composition. This means an increase in the content of lead in the graphite layer. The lead, however, adversely affects the electron emissivity of the hot cathode and consequently reduces the brightness of the luminescence.

SUMMARY OF THE INVENTION

It is therefore an object of the present invention to provide a substrate assembly for a luminescent display panel, which comprises graphite powder in segmented electrodes and yet makes the display panel give a brightest possible display.

It is another object of this invention to provide a substrate assembly of the type described, wherein the segmented electrodes tenaciously adhere to underlying electroconductive leads.

It is still another object of this invention to provide a substrate assembly of the type described, wherein the segmented electrodes tenaciously adhere to an insulating film formed on the substrate and around the segmented electrodes.

As described hereinabove, a substrate assembly for a luminescent display panel comprises a substrate of an electrically insulating material, a plurality of electroconductive leads on the substrate, and segmented electrodes on the electroconductive leads, respectively. In accordance with this invention, each of the segmented electrodes comprises graphite powder bound into a mass by a zinc oxide containing vitreous material that does not substantially include lead.

DESCRIPTION OF THE PREFERRED EMBODIMENT

Figure 1:
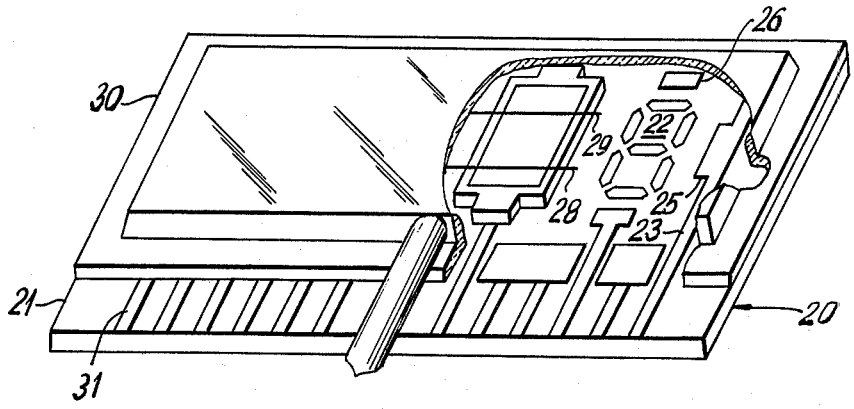
FIG. 1 schematically shows, with parts cut away, a perspective view of a luminescent display panel to which the present invention is applicable.

Referring to FIG. 1, a luminescent display panel comprises a substrate assembly 20 comprising, in turn, a substrate 21 of an electrically insulating material, such as glass, alumina, forsterite, or other ceramics, a plurality of display electrodes 22 on the substrate 21, and a plurality of electroconductive leads 23 also on the substrate 21. In the example being illustrated, the display electrodes 22 are arranged in a substantially figure-of-eight configuration and in a plurality of groups, each for a selected one of the numerals 0 to 9. The substrate assembly 20 further comprises a pair of cathode supports 25 connected to two of the conductive leads 23, respectively, and a plurality of pairs of grid supports 26, each pair being for a group of the display electrodes 22 and connected to one of the conductive leads 23. A grid 28 is attached to each pair of the grid supports 26 to cover a relevant one of the display electrode groups. At least one hot cathode 29 is extended above the grids 28 and attached at both ends to the cathode supports 25. The substrate assembly 20 with the grids 28 and cathodes 29 attached thereto is hermetically sealed to a glass cover sheet 30 by means of an interposed thin film of a low melting point glass with the display electrodes 22, the grids 28, and the cathodes 29 disposed in a hermetically sealed space. As shown, the conductive leads 23 are extended outwardly of the sealed space to serve as external leads 31 for supplying a heater voltage and a cathode potential to the cathodes 29 and for selectively supplying a grid voltage to the grids 28 and also the display electrode 22 with a potential that is positive with respect to the cathode potential. As described in the preamble of the instant specification, the substrate assembly 20 may be enclosed with a vacuum envelope (not shown) together with the cathode or cathodes 29 and grids 28 supported by the envelope.

Figure 2:
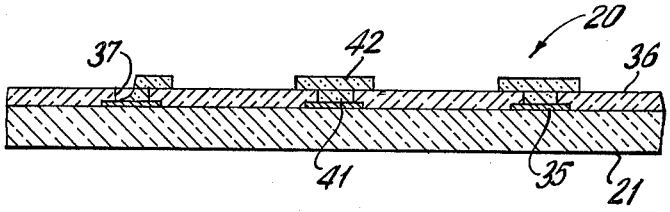
FIG. 2 is an enlarged schematic sectional view of a portion of a substrate assembly according to an embodiment of this invention for a luminescent display panel, such as illustrated in FIG. 1.

Referring now to FIG. 2, a substrate assembly 20 according to a preferred embodiment of the present invention comprises a plurality of those electroconductive leads 35 on the substrate 21 which may be formed, together with the electroconductive leads 23, in the manner described in the preamble of the instant specification. An insulating film 36 with openings or through holes 37 that subsequently become indents in a composite substrate comprising the substrate layer 21 and the film 36 is formed on the substrate layer 21 and on the conductive leads 35 and 23 as described also in the preamble. More particularly, the film 36 covers peripheral portions of the respective conductive leads 35 so that the through holes 37 may have their bottoms closed by the remaining central portions of the respective conductive electrodes 35. An intermediate graphite layer 41 is formed in each through hole or indent 37 and on the central portion of a relevant one of the conductive leads 35 said leads serving as interconnecting conductive leads for segment electrodes 42. In order to produce the graphite layer 41, the indents 37 are filled by the printing technique with a paste-like composition consisting essentially of graphite powder and a novel low melting point frit that contains zinc oxide but substantially no lead oxide. After drying in a usual manner, such as by heating the composite substrate having the conductive leads 35 and 23 and the prints of the paste-like composition in air to about 130° C for about twelve to thirteen minutes, the prints are made to be coplanar with the surface of the insulating film 36. Segmented graphite layers 42 are formed by again putting prints of the paste-like composition on the respective intermediate layers 41 and on those portions of the insulating film 36 which are contiguous to the through holes 37 and by firing the prints for the intermediate and segmented layers 41 and 42 at about 600° C. In this manner, an intermediate layer 41 and an overlying segmented layer 42 form a segmented electrode on which a mass of a luminescent material (not shown) is deposited to complete each of the display electrodes 22 (FIG. 1). It is now understood that each segmented electrode of a substrate assembly 20 according to this invention comprises graphite powder bound into a mass by a zinc oxide containing vitreous material that does not substantially contain lead.

In marked contrast to a known low melting point frit that is used to manufacture the graphite intermediate layers of a conventional substrate assembly 20 and containing up to about 60% by weight of lead oxide, the invention provides a novel frit for use in manufacturing the segmented electrodes of a substrate assembly 20 which contains from 30 to 40% by weight of zinc oxide and less than about 0.1% by weight of lead oxide. From 30 to 60% by weight of the novel frit is mixed with from 40 to 70% by weight of graphite powder together with a vehicle to produce a paste-like composition. Both graphite powder and vehicle are conventional ones. For example, the vehicle is a mixture of about 15% by weight of ethylcellulose and about 85% by weight of a known solvent therefor, such as diethyleneglycol monobutyl ether or diethyleneglycol monobutyl ether acetate. Parts by weight of the vehicle and the graphite powder plus the novel frit may be 1 and 3, respectively. The novel frit is manufactured in a conventional manner except for the materials which should include zinc oxide substantially free from lead oxide. It has been confirmed that the composition of the segmented electrodes of a substrate assembly 20 according to this invention does not appreciably vary through firing from the above-mentioned percentages.

The insulated film 36 is preferably comprised by a substrate assembly 20 according to this invention in order to optimally deposit the luminescent material on the segmented electrodes. The electroconductive leads 23 may be formed of fired liquid gold as taught in a copending patent application Ser. No. 688,900 filed May 21, 1976 (United Kingdom patent application No. 21117/76 filed May 21, 1976), by the present applicants.

With a luminescent display panel comprising a substrate assembly 20 according to the invention, it was possible to achieve as high a brightness as 250 foot-lambert with a filament voltage of 3.4 volts. The percentages by weight of the constituents of the novel frit used are given in the following table, wherein the total sum of the percentages is not equal to 100% due to inevitable experimental errors. The ignition loss was 0.3% by weight.

| $SiO_2$ | $Al_2O_3$ | $B_2O_3$ | $Na_2O$ | $Li_2O$ | ZnO | PbO |
|---|---|---|---|---|---|---|
| 10.3 | 1.3 | 44.7 | 7.1 | 2.1 | 34.7 | 0.02 |

Segmented elecrodes comprising graphite powder and vitreous material formed on the novel frit adhere well to the insulating film 36. Furthermore, the segmented electrodes prevent silver of the underlying electroconductive leads 35 from diffusing during use of the display panel into the masses of luminescent material to deteriorate the brightness.

What is claimed is:

1. In a substrate assembly for a luminescent display panel comprising a substrate of an electrically insulating material, a plurality of electroconductive leads on said substrate and segmented electrodes coupled to said leads, the improvement wherein:

each of said segmented electrodes is formed of a fired zinc oxide-containing vitreous material with graphite powder bound therein, the composition of said segmented electrodes comprising by weight about 40% to 70% graphite with 30% to 60% of the vitreous material making up essentially the balance, the amount of zinc oxide in said vitreous material ranging from about 30% to 40% by weight of the vitreous material, the lead content not exceeding about 0.1% by weight.

2. The substrate assembly of claim 1, wherein said vitreous material contains about 35% by weight of zinc oxide.

3. The substrate assembly of claim 1, said assembly also comprising a film of an insulating material on said substrate and on peripheral portions of said electroconductive leads, said film having through holes at central portions of said electroconductive leads, wherein said segmented electrodes comprise intermediate layers in said through holes and on said central portions and segmented layers on said intermediate layers and on those portions of said film which are contiguous to said through holes.

* * * * *